US012320544B1

(12) United States Patent
McGuire

(10) Patent No.: US 12,320,544 B1
(45) Date of Patent: Jun. 3, 2025

(54) DUST COVER AND METHOD OF USE TO PROTECT HVAC EQUIPMENT FROM DUST AND DEBRIS

(71) Applicant: BT GRACE HOMES INC., Magnolia, TX (US)

(72) Inventor: Kevin R. McGuire, Magnolia, TX (US)

(73) Assignee: BT GRACE HOMES INC., Magnolia, TX (US)

( * ) Notice: Subject to any disclaimer, the term of this patent is extended or adjusted under 35 U.S.C. 154(b) by 0 days.

(21) Appl. No.: 18/731,163

(22) Filed: May 31, 2024

(51) Int. Cl.
*F24F 13/20* (2006.01)

(52) U.S. Cl.
CPC ..... *F24F 13/20* (2013.01)

(58) Field of Classification Search
CPC ..... F24F 13/20
USPC ..... 454/367
See application file for complete search history.

(56) References Cited

U.S. PATENT DOCUMENTS

| | | | | |
|---|---|---|---|---|
| 1,490,186 | A * | 4/1924 | Rowe | F01M 13/0405 454/367 |
| 3,578,027 | A | 5/1971 | Zopfi | |
| 4,712,343 | A | 12/1987 | Dearing et al. | |
| 6,478,673 | B1 * | 11/2002 | Haynes | F24F 13/06 454/292 |
| 6,558,248 | B1 | 5/2003 | Moore, Jr. et al. | |
| 6,749,499 | B1 | 6/2004 | Snyder | |
| 6,835,129 | B1 | 12/2004 | Harris | |
| 6,874,541 | B2 | 4/2005 | Vossen | |
| 6,908,115 | B2 | 6/2005 | Snyder | |
| 6,957,896 | B2 * | 10/2005 | Burgess | F21S 8/026 52/220.8 |
| 6,959,520 | B2 | 11/2005 | Hartman | |
| 7,390,251 | B2 | 6/2008 | Hadlock, Jr. | |
| 8,875,905 | B2 | 11/2014 | Rothleitner | |
| 10,228,155 | B2 | 3/2019 | Harmon | |
| 2008/0318511 | A1 | 12/2008 | Becker | |
| 2010/0003913 | A1 | 1/2010 | Sanchez | |
| 2012/0289145 | A1 | 11/2012 | Kerlinger, Jr. | |
| 2013/0072104 | A1 | 3/2013 | Picco et al. | |
| 2019/0024936 | A1 * | 1/2019 | Richie | F24F 13/085 |
| 2024/0209974 | A1 * | 6/2024 | Clark | A01M 29/30 |

FOREIGN PATENT DOCUMENTS

| | | |
|---|---|---|
| CA | 2 638 103 | 1/2010 |
| CN | 106051371 | 10/2016 |
| DE | 202010010572 | 12/2011 |

(Continued)

*Primary Examiner* — Avinash A Savani
*Assistant Examiner* — Dana K Tighe
(74) *Attorney, Agent, or Firm* — Quisenberry Law PLLC

(57) ABSTRACT

Dust covers for use in protecting HVAC equipment from dust and debris during construction are disclosed. A dust cover may include a main body member having an upper surface and an annular wall extending downwardly away from the upper surface; and a plurality of flexible tabs extending downwardly from the annular wall. The flexible tabs may include an upper transverse groove and a lower transverse groove. The upper transverse groove may be between the lower transverse groove and the upper surface. The annular wall may include a plurality of evenly spaced slits defining the flexible tabs therebetween. The slits may be parallel to each other.

16 Claims, 4 Drawing Sheets

(56) References Cited

FOREIGN PATENT DOCUMENTS

| | | |
|---|---|---|
| DE | 102021103628 | 8/2022 |
| JP | 05066046 | 3/1993 |
| WO | WO 2005/124054 | 12/2005 |

* cited by examiner

DUST COVER AND METHOD OF USE TO PROTECT HVAC EQUIPMENT FROM DUST AND DEBRIS

BACKGROUND OF THE INVENTIONS

1. Field of the Inventions

The present inventions generally pertain to building construction, and more particularly to dust covers and methods of using dust covers to protect HVAC equipment from becoming contaminated with airborne dust and debris during construction.

2. Description of the Related Art

It is known that construction sites for homes and commercial structures can be littered with dirt, dust and debris, such as saw dust and dust from sanding sheetrock, for example. This dust and debris becomes airborne and moves through the interior of the structure under construction. This routinely happens after HVAC equipment and its associated duct work has been installed. It is important to prevent the dust and debris from entering the duct work and making its way to the inside of the HVAC equipment. This can cause the HVAC equipment to function improperly. This problem is currently addressed by placing tape over the points of entry into the ducts. However, it is not uncommon for tape to eventually come loose and fall off.

As will become apparent from the description and explanation set forth below, the present inventions overcome the above-described problem by providing dust covers and related methods for covering the points of entry into HVAC ducts.

SUMMARY OF THE INVENTIONS

In one aspect, the present inventions may include a dust cover comprising: a main body member having an upper surface and an annular wall extending downwardly away from the upper surface; and a plurality of flexible tabs extending downwardly from the annular wall. Another feature of this aspect of the present inventions may be that each flexible tab includes an upper transverse groove. Another feature of this aspect of the present inventions may be that each flexible tab includes a lower transverse groove. Another feature of this aspect of the present inventions may be that each flexible tab includes an upper transverse groove and a lower transverse groove. Another feature of this aspect of the present inventions may be that the upper transverse groove is between the lower transverse groove and the upper surface. Another feature of this aspect of the present inventions may be that the annular wall includes a plurality of evenly spaced slits defining the flexible tabs therebetween. Another feature of this aspect of the present inventions may be that the slits are parallel to each other.

In another aspect, the present inventions may include a dust cover comprising: a main body member having an upper surface and an annular wall extending downwardly away from the upper surface; and a plurality of flexible tabs extending downwardly from the annular wall, each flexible tab including an upper transverse groove. Another feature of this aspect of the present inventions may be that each flexible tab further includes a lower transverse groove. Another feature of this aspect of the present inventions may be that the upper transverse groove is between the lower transverse groove and the upper surface. Another feature of this aspect of the present inventions may be that the annular wall includes a plurality of evenly spaced slits defining the flexible tabs therebetween. Another feature of this aspect of the present inventions may be that the slits are parallel to each other.

In yet another aspect, the present inventions may include a dust cover comprising: a main body member having an upper surface and an annular wall extending downwardly away from the upper surface; and a plurality of flexible tabs extending downwardly from the annular wall, each flexible tab including an upper transverse groove and a lower transverse groove. Another feature of this aspect of the present inventions may be that the upper transverse groove is between the lower transverse groove and the upper surface. Another feature of this aspect of the present inventions may be that the annular wall includes a plurality of evenly spaced slits defining the flexible tabs therebetween. Another feature of this aspect of the present inventions may be that the slits are parallel to each other.

Other features, aspects and advantages of the present inventions will become apparent from the following discussion and detailed description.

While the inventions will be described in connection with the preferred embodiments, it will be understood that the scope of protection is not intended to limit the inventions to those embodiments. On the contrary, the scope of protection is intended to cover all alternatives, modifications, and equivalents as may be included within the spirit and scope of the inventions as defined by the appended claims.

DETAILED DESCRIPTION OF THE INVENTION

Figure 1:
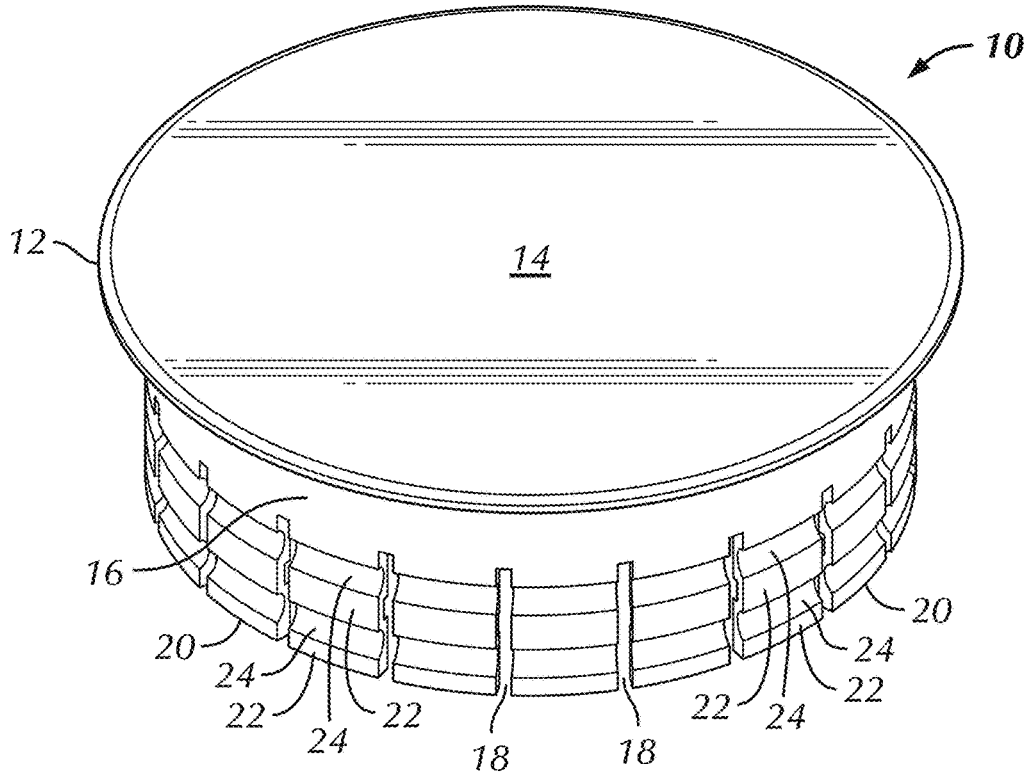
FIG. 1 is a top perspective view of a specific embodiment of a dust cover constructed in accordance with one aspect of the present inventions.
Figure 2:
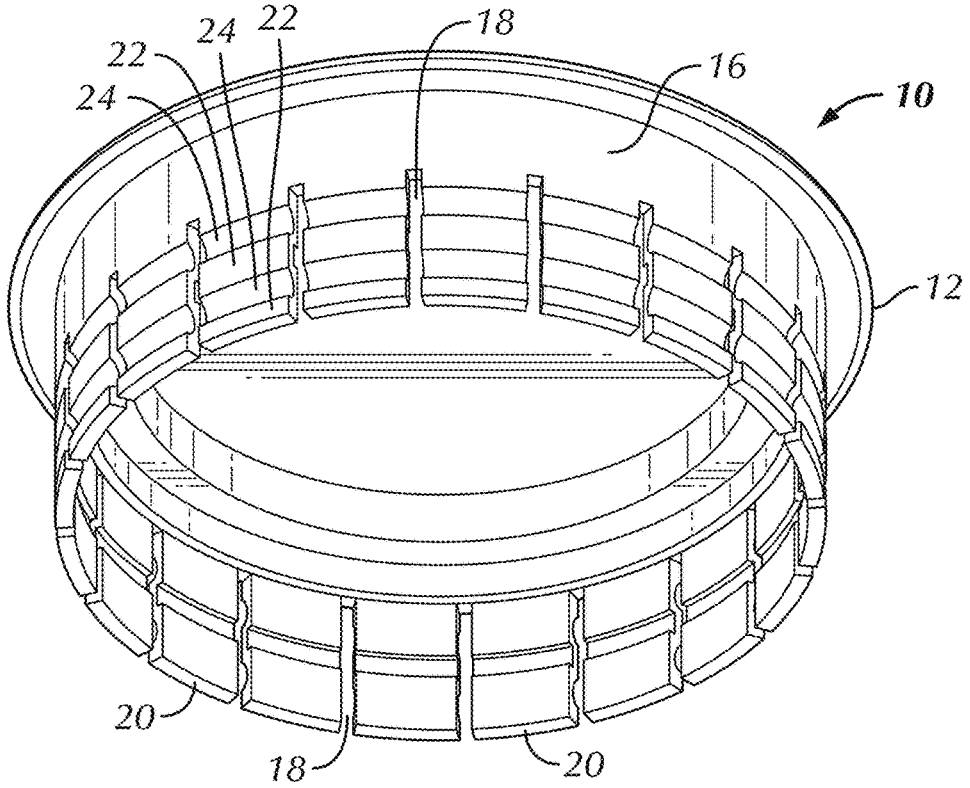
FIG. 2 is lower perspective view of the dust cover shown in FIG. 1.

Referring to the drawings in detail, wherein like numerals denote identical elements throughout the several views, and referring initially to FIGS. 1 and 2, there is shown a perspective view of a dust cover 10. The dust cover 10 may include a main body member 12 having an upper surface 14. In a specific embodiment, the upper surface 14 may be generally flat or planar. In a specific embodiment, the main body member 12 may be circular in shape and include an annular or ring-shaped wall 16 extending downwardly from the upper surface 14. In a specific embodiment, the annular wall 16 may include a plurality of slits 18 defining a plurality of flexible tabs or fingers 20. In a specific embodiment, the slits 18 may be generally parallel to one another and disposed in generally perpendicular relationship to the upper surface 14. In a specific embodiment, the slits 18 may be generally evenly spaced around the circumference of the annular wall 16 so as to form flexible tabs 20 of generally the same width. In a specific embodiment, outer surfaces of the flexible tabs 20 may include one or more transverse ridges 22 and corresponding transverse grooves 24. In a specific embodiment, each tab 20 may include an upper groove 24 closer to the upper surface 14. In a specific embodiment, each tab 20 may include a lower or distal groove 24 that is further away from the upper surface 14 or adjacent a lower end of the tab 20. In a specific embodiment, each tab 20 may include a lower/distal groove 24 and an upper groove 24 positioned between the lower/distal groove 24 and the upper surface 14. As will be explained further, the flexible tabs 20 and grooves 24 function to engage and grip interior surfaces of points of entry into HVAC ducts such that the dust cover 10 will be securely positioned within the point of entry.

Figure 3:
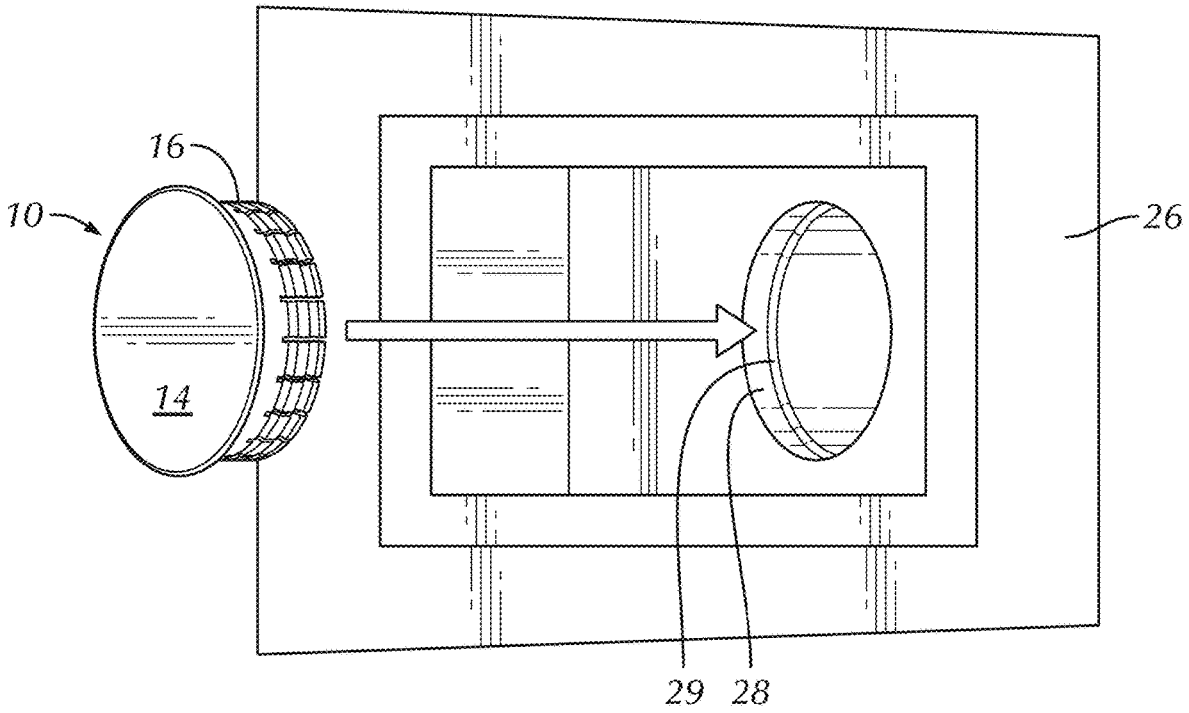
FIG. 3 is a perspective view illustrating a specific embodiment of a process of using a dust cover to cover a point of entry into a section of HVAC duct.
Figure 4:
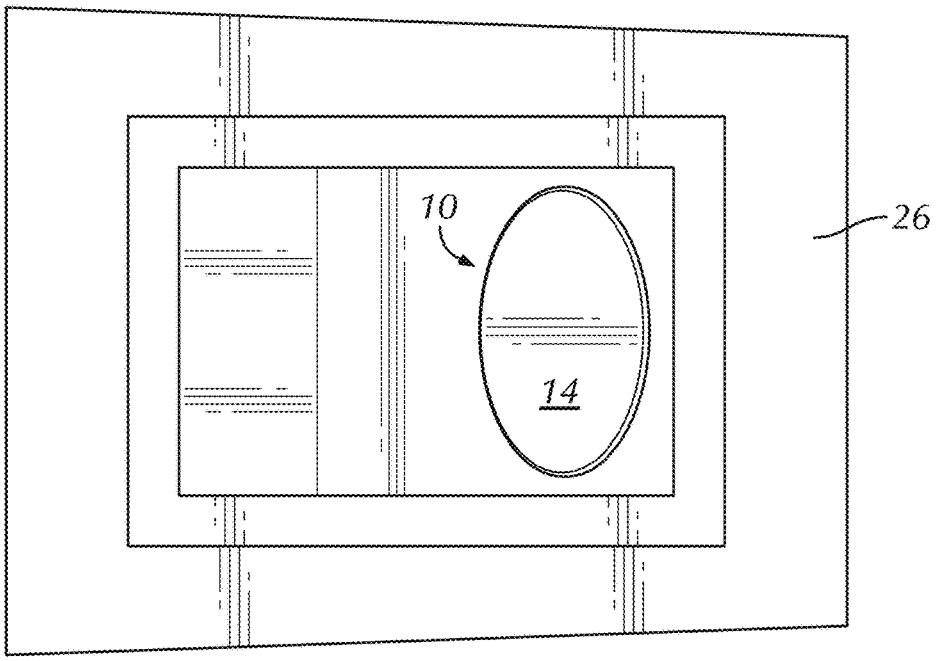
FIG. 4 is a perspective view similar to FIG. 3 but showing the dust cover after it has been installed to cover the point of entry.

Referring to FIG. 3, a portion of an HVAC duct 26 is shown having a point of entry or pipe duct 28. In a specific embodiment, the point of entry 28 may be the end of a circular pipe. As indicated by the arrow shown in FIG. 3, the dust cover 10 is shown in the process of being inserted into the point of entry 28. The main body member 12 and annular wall 16 is sized such that the annular wall 16 and tabs 20 will closely fit within the point of entry 28 to form a snug engagement therewith. In a specific embodiment, an inner surface of the pipe duct 28 may include an annular ridge or protuberance 29, which may be sized and positioned for engagement with the transverse grooves 24 on the dust cover 10. As the dust cover 10 is being inserted into the pipe duct 28, the transverse grooves 24 that are furthest away from the main body member 12 will interact with the annular ridge 29 on the inside of the pipe duct 28 and assist in aligning the dust cover 28 with the pipe duct 28 as the dust cover 28 is being inserted. As it is being further inserted, the transverse grooves 24 closest to the main body member 12 will then engage with the annular ridge 29 to lock the dust cover 28 in place. FIG. 4 shows the dust cover 10 in an installed position and engaged with the point of entry 28.

Figure 5:
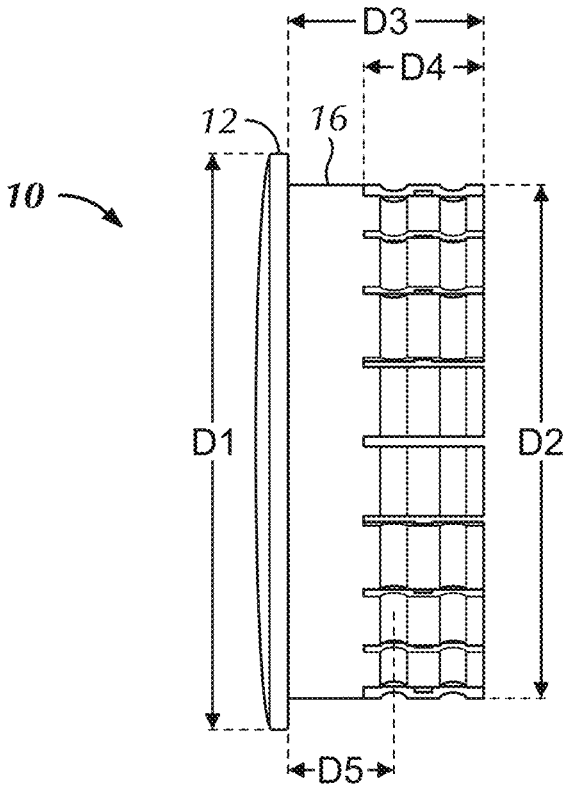
FIG. 5 is a side view of a dust cover according to the present inventions, and illustrating various dimensions.
Figure 6:
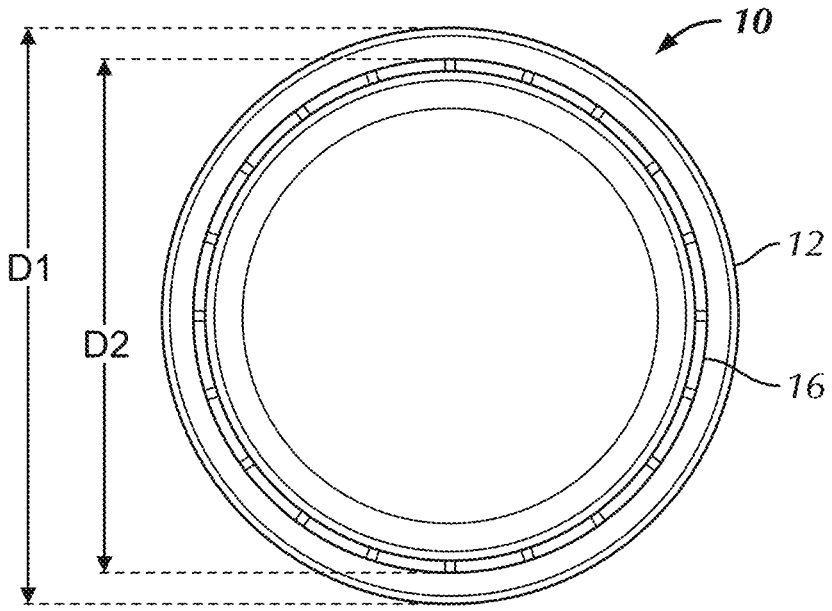
FIG. 6 is a top view of a dust cover according to the present inventions, and illustrating various dimensions.
Figure 7:
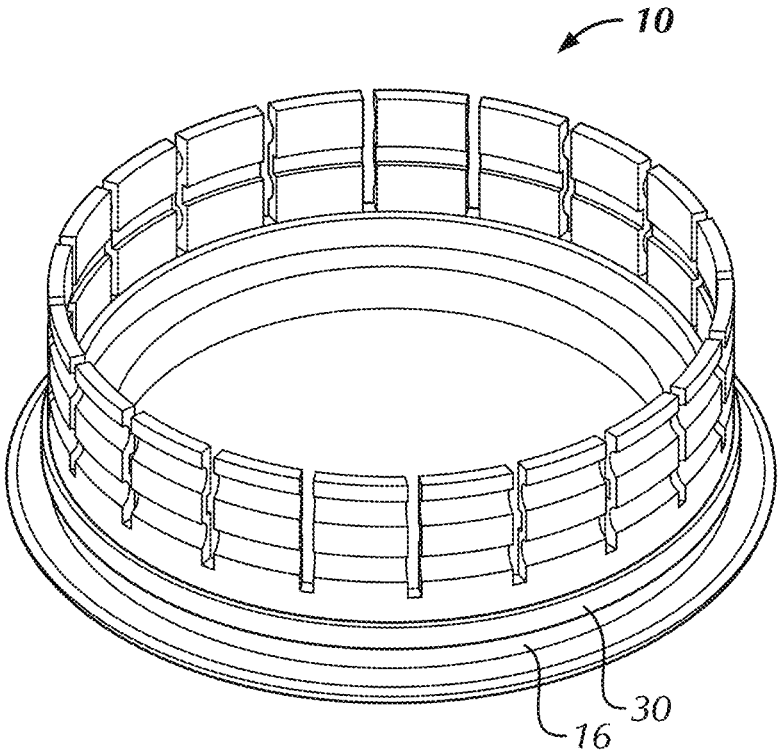
FIG. 7 is a perspective view of a specific embodiment of a dust cover constructed in accordance with one aspect of the present inventions.
Figure 8:
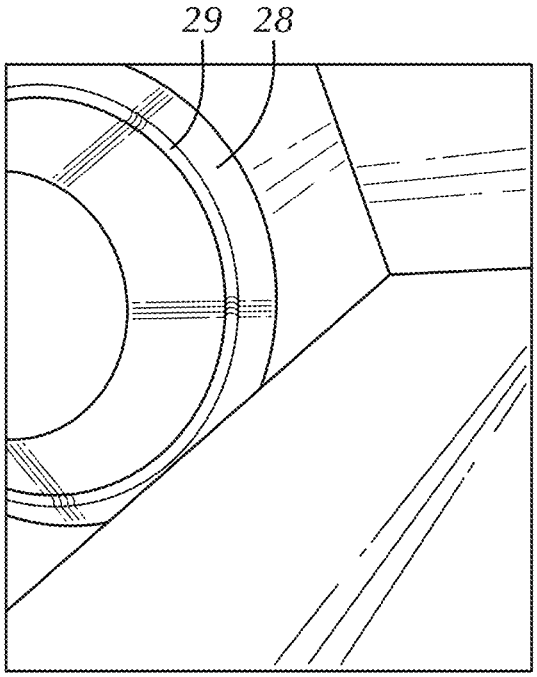
FIG. 8 is a perspective view of a point of entry into an HVAC duct and illustrating an annular projection or ridge around an inner surface of the point of entry.

Specific embodiments of dust covers 10 may be sized for engagement with and covering a broad variety of sizes of pipe ducts, which can include, for example, the following pipe diameters: 3", 4", 5", 6", 7", 8", 9", 10", 12", 14", 16", 18", 20", and 24". The size is selected based on the desired air flow in cubic feet per minute (CFM) for the design of the HVAC system. With reference to FIGS. 5 and 6, various dimensions D1, D2, D3, D4, and D5 are identified. In a specific embodiment, such as for a pipe duct 28 having a diameter of 4 inches, D1 may be 4¼ inches, and D2 may be approximately (or slightly less than) 4 inches. In other specific embodiments, including for any of the diameter sizes listed above, D3 may be approximately 1¼ inches, D4 may be approximately ¾ inches, and D5 may be approximately ⅝ inches. These dimensions are provided as examples only. The present inventions are not limited to any particular dimensions or pipe duct sizes.

It is to be understood that the inventions disclosed herein are not limited to the exact details of construction, operation, exact materials or embodiments shown and described. Although specific embodiments of the inventions have been described, various modifications, alterations, alternative constructions, and equivalents are also encompassed within the scope of the inventions. Although the present inventions may have been described using a particular series of steps, it should be apparent to those skilled in the art that the scope of the present inventions is not limited to the described series of steps. The specification and drawings are, accordingly, to be regarded in an illustrative rather than a restrictive sense. It will be evident that additions, subtractions, deletions, and other modifications and changes may be made thereunto without departing from the broader spirit and scope of the inventions as set forth in the claims set forth below. Accordingly, the inventions are therefore to be limited only by the scope of the appended claims. None of the claim language should be interpreted pursuant to 35 U.S.C. 112(f) unless the word "means" is recited in any of the claim language, and then only with respect to any recited "means" limitation.

The invention claimed is:

1. A dust cover for temporary engagement with a duct associated with an item of HVAC equipment during construction of a structure to cover the duct and prevent construction debris from entering the duct, the duct having an interior surface and an annular ridge disposed therearound, the dust cover comprising:

a main body member having an upper surface and an annular wall extending downwardly away from the upper surface, the main body member lacking any air openings disposed therein; and a plurality of flexible tabs extending downwardly from the annular wall, each flexible tab including at least one transverse groove adapted for temporary and removable mating engagement with the annular ridge on the interior surface of the duct to secure a lower surface of the upper surface of the main body member in contact with an outer surface of the duct.

2. The dust cover of claim 1, wherein each flexible tab includes an upper transverse groove.

3. The dust cover of claim 1, wherein each flexible tab includes a lower transverse groove.

4. The dust cover of claim 1, wherein each flexible tab includes an upper transverse groove and a lower transverse groove.

5. The dust cover of claim 4, wherein the upper transverse groove is between the lower transverse groove and the upper surface.

6. The dust cover of claim 1, wherein the annular wall includes a plurality of evenly spaced slits defining the flexible tabs therebetween.

7. The dust cover of claim 6, wherein the slits are parallel to each other.

8. A dust cover for temporary engagement with a duct associated with an item of HVAC equipment during construction of a structure to cover the duct and prevent construction debris from entering the duct, the duct having an interior surface and an annular ridge disposed therearound, the dust cover comprising:

a main body member having an upper surface and an annular wall extending downwardly away from the upper surface, the main body member lacking any air openings disposed therein; and a plurality of flexible tabs extending downwardly from the annular wall, each flexible tab including an upper transverse groove configured for temporary and removable mating engagement with the annular ridge on the interior surface of the duct to secure a lower surface of the upper surface of the main body member in contact with an outer surface of the duct.

9. The dust cover of claim 8, wherein each flexible tab further includes a lower transverse groove.

10. The dust cover of claim 9, wherein the upper transverse groove is between the lower transverse groove and the upper surface.

11. The dust cover of claim 8, wherein the annular wall includes a plurality of evenly spaced slits defining the flexible tabs therebetween.

12. The dust cover of claim 11, wherein the slits are parallel to each other.

13. A dust cover for temporary engagement with a duct associated with an item of HVAC equipment during construction of a structure to cover the duct and prevent construction debris from entering the duct, the duct having an interior surface and an annular ridge disposed therearound, the dust cover comprising:

a main body member having an upper surface and an annular wall extending downwardly away from the upper surface, the main body member lacking any air openings disposed therein; and a plurality of flexible tabs extending downwardly from the annular wall, each flexible tab including an upper transverse groove and a lower transverse groove, at least one of the upper and lower transverse grooves being configured for temporary and removable mating engagement with the annular ridge on the interior surface of the duct to secure a lower surface of the upper surface of the main body member in contact with an outer surface of the duct.

14. The dust cover of claim 13, the upper transverse groove is between the lower transverse groove and the upper surface.

15. The dust cover of claim 13, wherein the annular wall includes a plurality of evenly spaced slits defining the flexible tabs therebetween.

16. The dust cover of claim 15, wherein the slits are parallel to each other.

* * * * *